United States Patent [19]

Canton

[11] Patent Number: 4,829,757

[45] Date of Patent: May 16, 1989

[54] APPARATUS FOR FORMING A COMPOSITE YARN FROM ELASTIC AND INELASTIC YARNS

[75] Inventor: Armando Canton, Solbiate Arno, Italy

[73] Assignee: Fadis S.P.A., Solbiate Arno, Italy

[21] Appl. No.: 126,209

[22] Filed: Nov. 25, 1987

[30] Foreign Application Priority Data

Nov. 26, 1986 [IT] Italy ..... 22460 A/86
Nov. 13, 1987 [IT] Italy ..... 22621 A/87

[51] Int. Cl.[4] ..... D02G 1/16; D02G 1/18; D02G 3/32; D02G 3/34

[52] U.S. Cl. ..... 57/6; 28/252; 28/271; 57/91; 57/207; 57/208; 57/225; 57/226; 57/350; 57/295

[58] Field of Search ..... 57/6, 7, 12, 350, 91, 57/225, 226, 295, 207–210; 28/271–276, 252, 254

[56] References Cited

U.S. PATENT DOCUMENTS

| | | | |
|---|---|---|---|
| 4,069,657 | 1/1978 | Bascom et al. | 57/6 |
| 4,319,447 | 3/1982 | Barron | 57/6 |
| 4,497,099 | 2/1985 | Scott | 28/273 X |
| 4,567,720 | 2/1986 | Price | 57/350 X |
| 4,598,538 | 7/1986 | Moore, Jr. | 57/6 X |
| 4,615,167 | 10/1986 | Greenberg | 28/273 X |

*Primary Examiner*—John Petrakes
*Attorney, Agent, or Firm*—Herbert Dubno

[57] ABSTRACT

An apparatus for the production of a yarn has a joining group provided with a frame carrying a pneumatic-joining assembly, a unit for conditioning substantially inelastic yarns and feeding them to the pneumatic-joining assembly and a unit for feeding an elastic strand to the latter. A common drive is provided with individually adjustable transmission ratios using conical pulleys and belts.

25 Claims, 9 Drawing Sheets

APPARATUS FOR FORMING A COMPOSITE YARN FROM ELASTIC AND INELASTIC YARNS

FIELD OF THE INVENTION

My present invention relates to an apparatus for making a composite yarn from inelastic and elastic strands, sometimes also referred to herein as inelastic yarn and elastic yarn respectively. More particularly, the invention relates to the use of a pneumatic jet for coalescing at least one substantially inelastic yarn or strand and at least one elastic strand or yarn into a composite yarn.

BACKGROUND OF THE INVENTION

To produce yarns with high elasticity and so-called "mixed-effect" yarns with different color and texture effects, composite yarns can be formed from one or more basic strands consisting of natural or synthetic filaments and having a limited elongation under tension so that they can be termed inelastic yarns or strands. Included among such strands are textured nylon filaments and strands which are monofilamentary in nature but textured, as well as multifilament or discontinuous-filament yarns or strands.

The elastic strands may be composed of elastomeric materials, such as rubber.

The joining of the two types of strands to form the composite yarn may be done in such a way that the composite yarn will have a pleasant feel or "hand" and to bring out the aesthetic characteristics of the composite yarn, while nevertheless retaining the elastic qualities thereof. This means that the elastic strands which provide the high degree of elongation and rebound from deformation should be provided in the interior of the composite yarn while the inelastic strands dominate the external surface of the composite yarn.

In the past, this has generally been accomplished by twisting the inelastic strand or strands in a helical pattern around the elastic strand or strands so that the latter form a core encased in the twisted sheath formed by the inelastic strand or strands.

Since the twisting process is comparatively slow, its productivity is poor and the cost of the composite yarn as a result is high. This applies when composite elasticized yarns are formed from inelastic strands of synthetic fiber such as nylon, polyester, polypropylene and the like which may be subjected to texturizing and false twisting.

It is possible to produce a composite yarn by matting and coalescing fibers of an inelastic strand to an elastic strand by subjecting these fibers to deflection by a pneumatic jet. Up to now, however, there has not been available to my knowledge an effective machine for carrying out a process of this type or, for that matter, an effective process for the high production rate generation of composite yarns.

It appears, that attempts to mat the aforementioned inelastic strands to the elastic strand have been strongly dependent not only on the types of yarns or strands used, but upon the conditions under which the strands were supplied to the jet, making the product nonuniform in character.

OBJECTS OF THE INVENTION

It is the principal object of my present invention to provide an improved apparatus for making a composite yarn whereby these drawbacks are avoided and the elastic composite yarn, with a pleasant feel and good "hand" can be produced at a high rate and with a high degree of uniformity at comparatively low cost.

Another object of my invention is to provide an improved method of forming composite yarn with the advantages mentioned immediately above.

SUMMARY OF THE INVENTION

I have found that the production of a composite yarn can be greatly improved if the composite yarn is produced by the combination of the following steps:

(A) feeding an elastic strand composed of an elastomeric material through a pneumatic-joining assembly while stretching the strand so that the elastic strand is under tension in the pneumatic-joining assembly;

(B) simultaneously feeding at least one substantially inelastic strand, e.g. of a natural filamentary or one of the synthetic filamentary materials previously described, i.e. of continuous texturized synthetic fiber or discontinuous natural or synthetic fiber, to the pneumatic-joining assembly in contact with the elastic strand;

(C) directing at least one pneumatic jet against the inelastic strand in the pneumatic-joining assembly to cause the elastic strand to mat to and coalesce with the elastic strand, thereby forming a composite yarn;

(D) relaxing the tension in the elastic strand and winding up the composite yarn on a spool;

(E) humidifying or wetting the inelastic strand before it is fed to the pneumatic-joining assembly to increase the susceptibility of the inelastic strand or the fibers thereof to deflection by the pneumatic jet.

According to the apparatus aspects of the invention, therefore, the apparatus for coalescing a plurality of strands into a composite yarn comprises:

a pneumatic-joining assembly adapted to receive a plurality of strands and provided with at least one pneumatic jet adapted to cause matting of the strands and coalescence thereof into the composite yarn;

means for feeding at least one substantially inelastic strand of continuous texturized synthetic fiber or discontinuous natural or synthetic fiber to the pneumatic-joining assembly; and means interposed between the feed means for the inelastic strand and the pneumatic-joining assembly for conditioning the inelastic strand to facilitate its coalescence with the elastic strand.

The conditioning means can include means for controlling the tension of the inelastic strand and means for humidifying or wetting the inelastic strand for the purposes described.

The unit for supplying one or more inelastic strands is connected to a joining unit and this latter unit may comprise means for the support and rotation of a spool of elastic yarn or an elastic strand and guide means for deflecting the latter in guiding it to the pneumatic-jet assembly.

The joining unit may also comprise the collection or take-up means for winding the composite yarn on the spool and, of course, the pneumatic-joining assembly which is equipped with a pneumatic jet, the means for tensioning and controlling the tension of the inelastic strands and for wetting the same and, of course, means for mounting the joining unit on the machine.

The joining unit can, moreover, comprise a pair of motor-driven rollers for supplying and rotating the spool carrying the elastic strand, at least one motorized roller for feeding and drafting (tensioning) the inelastic strand, a fixed roller body serving to brake the inelastic strand, a humidifying or moisturizing drum for the inelastic strand and a motor-driven roller applying traction to the composite yarn before it is fed to take-up the spool.

The roller for applying traction to and feeding the inelastic strand and the roller for applying traction to and feeding the composite yarn can be coaxial and rigid with one another, having different diameters corresponding to the drafting tension which is applied to the inelastic yarn and to the composite yarn prior to and subsequent to coalescence, respectively.

It has been found to be advantageous to provide the drafting and traction roller for the inelastic strand or strands and the fixed-roller body for the transmission and braking of the inelastic strand, disposed upstream from the pneumatic-joining assembly with the air-jet nozzle with grooved surfaces capable of engaging the strand or strands for holding the same in position and preventing slippage of the inelastic strand.

According to the invention, the relationship between the speed of traction and the feed roller and the braking roller body is such that the tension in the inelastic strand or strands is reduced practically to zero in a plurality of passes or loops before the inelastic strand or strands meet the elastic strand.

The drafting and feeding for the composite yarn has a diameter such as to ensure that the tension of the composite yarn passing through the pneumatic-joining assembly compensates for braking action imposed on the composite yarn in the latter assembly and further such that the elastic strand is stretched with an elongation of 100% to 1000% as it passes through the pneumatic-joining assembly.

According to the invention, moreover, the inelastic strand winds about the traction roller and fixed body in a plurality of convolutions until the tension in the inelastic strand or strands has been reduced to zero.

The fixed body can be made of a ceramic material or another low-wear material capable of developing friction on the surface of the inelastic strand.

The coaxially joined rollers for feeding the composite yarn are driven by one or more conical pulleys engaged by a moving belt which is transversely shiftable to allow the transmission ratio from the drive to the driven elements to be selected for best results for the various types of inelastic strands used.

A common motor can be provided for the unit which takes up the composite yarn on the spool, rotates the elastic strand-supply spool and applies traction to the inelastic strand for the composite yarn.

In some cases, for the production of special kinds of composite yarn, a further roller can be provided for feeding inelastic strands to independently supply to the pneumatic-joining assembly one or more inelastic strands of diverse fibers.

The further feeding roller can be driven by a conical pulley engaged by the same transmission belt mentioned previously but provided with an autonomous guide for the controllable belt allowing an independent adjustment of the rotational speed of this further feed roller.

BRIEF DESCRIPTION OF THE DRAWING

The above objects, features and advantages of my invention will become more readily apparent from the following description, reference being made to the accompanying highly schematic drawing in which.

SPECIFIC DESCRIPTION

Figure 7:
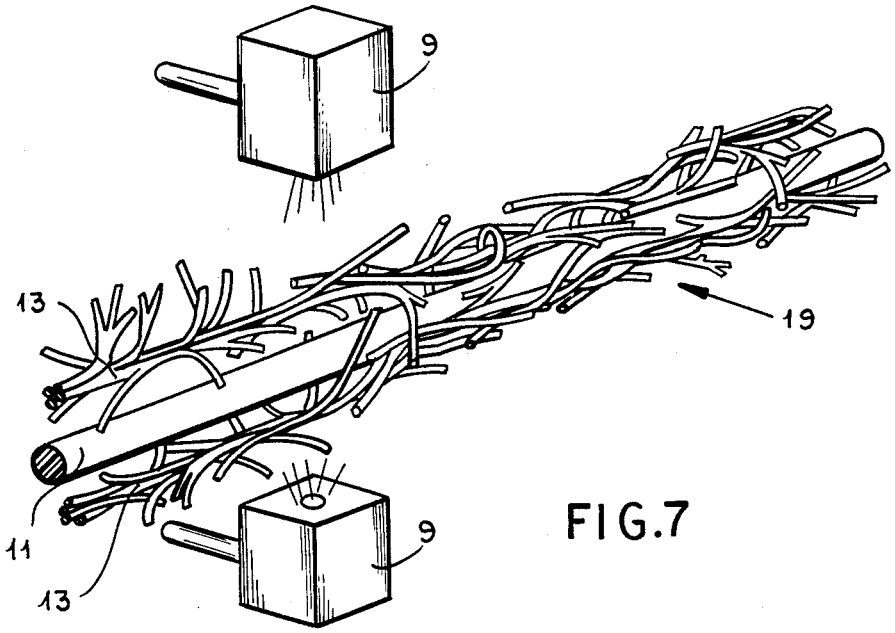
FIG. 7 is an enlarged perspective view of a pair of inelastic yarns with discontinuous filaments joined with a single continuous elastic yarn.
Figure 8:
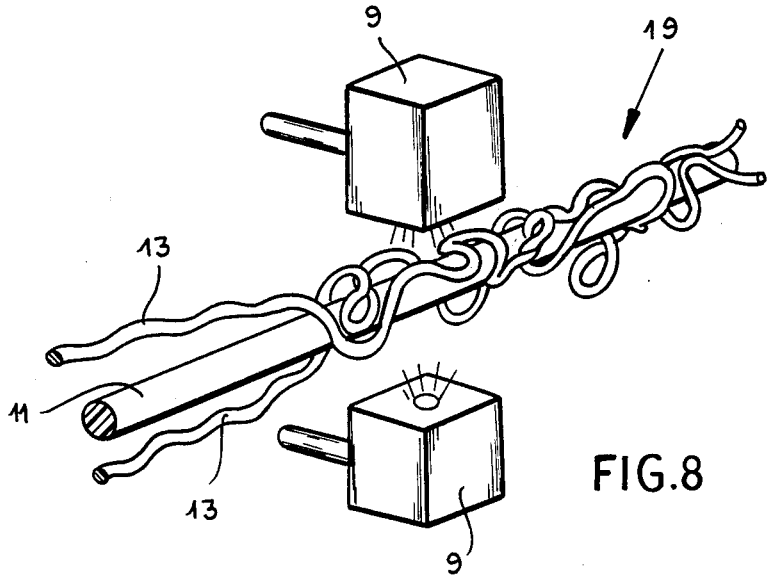
FIG. 8 is a similar view showing a pair of texturized continuous yarns joined with an elastic yarn.

Referring briefly first to FIG. 7 or FIG. 8, it can be seen that the principle of this invention is that an elastic strand 11 can be fed in close contact with at least one and, as illustrated in FIGS. 7 and 8, two inelastic strands 13, the latter having been wetted so that the fibers of the inelastic strand 13 (in the case of FIG. 7) or the strands themselves (in the case of FIG. 8) are highly susceptible to deflection by pneumatic jets trained on the yarns from nozzles 9.

As previously described, the elastic strand is in a highly stretched state and, after passing through the pneumatic-jet assembly, is relaxed so that the composite yarn 19 which is formed is contracted and effectively has its elastic strand 11 fully sheathed in the fibers of the inelastic strands 13 which are matted around the elastic strand.

It is also possible, within the scope of the invention and as seen in FIG. 8, to use inelastic strands 13 which are textured but are not fibrous in nature to cause these strands to deflect by the pneumatic jets around and against the elastic strand 11 which is also highly stretched. As will be apparent from FIG. 8, when the composite yarn 19 is relaxed, before being wound-up, the composite yarn will have the inelastic strand 13 closely surrounding and coalesced with the elastic strand 11.

In both instances and, of course, when the inelastic strands are greater in number and combinations of fibers and monofilament strands, the inelastic strands are not wound continuously around the core, nor is the core and the inelastic strand or strands twisted together, but rather the inelastic strands coalesce with one another and the elastic strands in a matting effect induced by the deflection of the inelastic strands by the pneumatic jets, an effect which is augmented by the prior wetting of the inelastic strand so that it, or its fibers, will have a greater mass and thus be amenable to deflection by the energy of the air jets.

Figure 1:
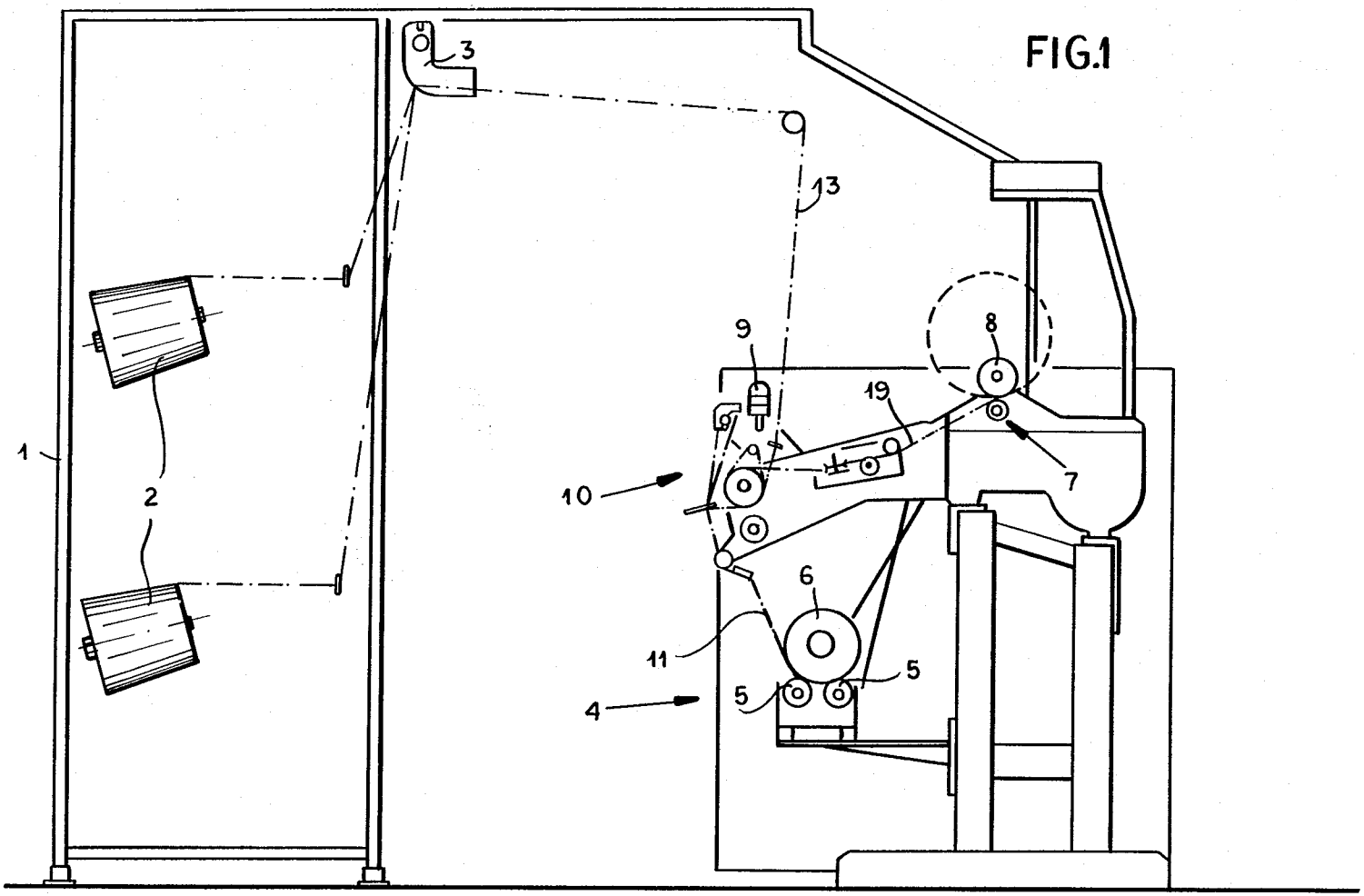
FIG. 1 is a side-elevational view in highly schematic form showing the layout of a machine according to the invention.

The machine shown in FIG. 1 for producing a composite yarn by coalescence of inelastic and elastic strands comprises a support frame 1 for spools 2 of respective inelastic yarns or strands 13 which are passed via a yarn sensor 3 to a unit or assembly 10 for positioning the inelastic strands and adapted to place them in the best condition for being joined with the elastic strand. The joining apparatus as a whole is identified at 4 and the yarn sensor serves to detect the presence of the inelastic strands and to control via means not shown the uniform and continuous supply of inelastic strands to the joining unit.

The joining unit 4 comprises support and rotation rollers 5 which cradle a bobbin 6 carrying the elastic strand 11, a take-up unit or assembly 7 for winding the composite yarn on a spool 8, the pneumatic joining assembly 9 with air jets as described, and the conditioning assembly 10 mentioned previously.

Figure 2:
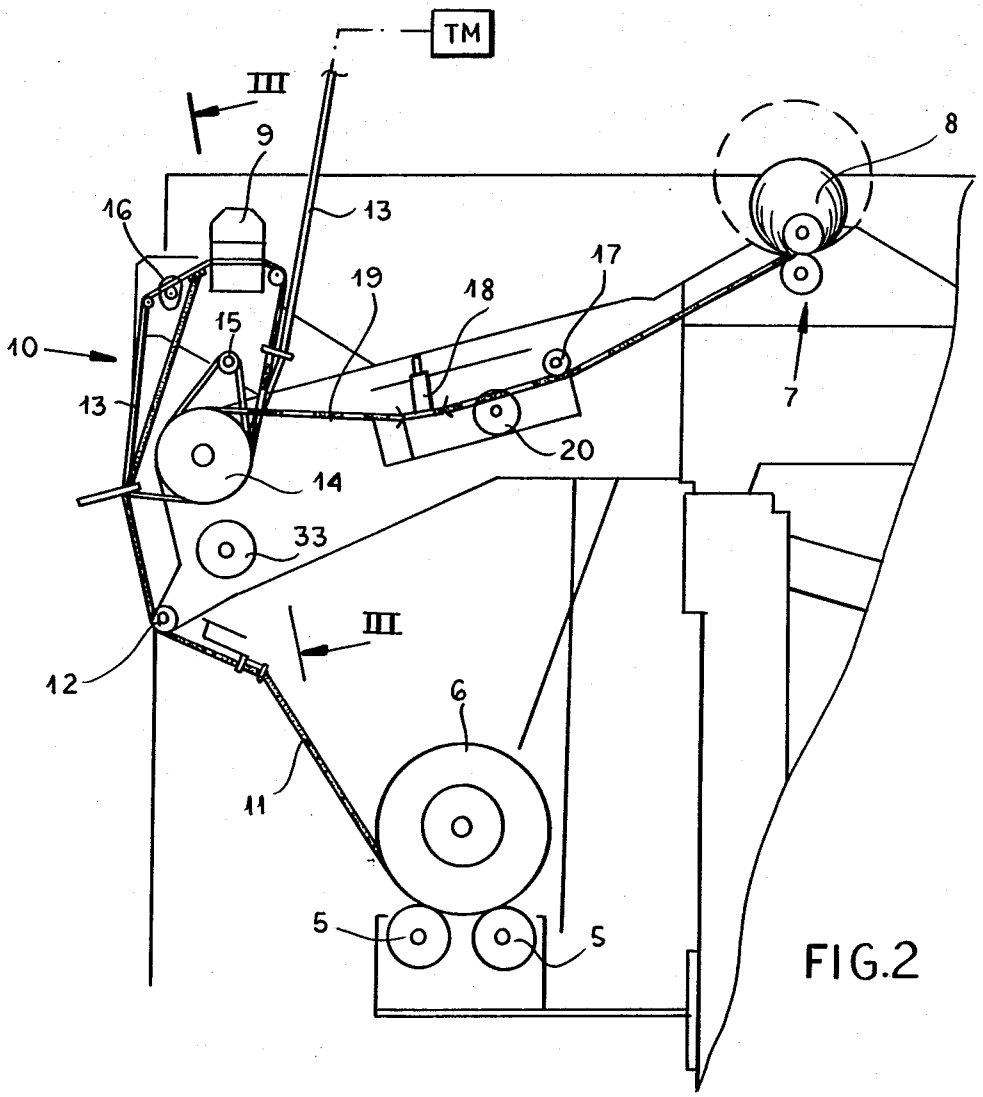
FIG. 2 is a similar view of an enlarged detail of the yarn-feeding portion of the machine.
Figure 3:
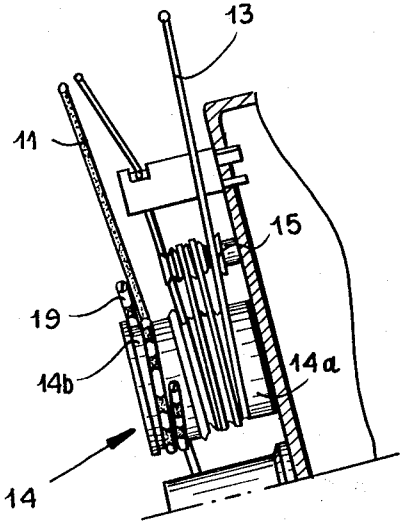
FIG. 3 is a section taken along the line III—III of FIG. 2.

As can be seen in greater detail from FIGS. 2 and 3, the elastic yarn or strand 11, which is shown as a heavy line, coming from the bobbin 6 is guided over the guide roller and through a feed means to the pneumatic-joining assembly 9.

The inelastic strands 13 of which only one is required, although two are shown and which can be more than two in number, are represented in light lines in FIGS. 2 and 3 and are received from the spools 2 (FIG. 1).

These inelastic strands 13 wind around a motor-driven roller 14 which has two portions, the first of which is shown at 14*a* and serves to feed the inelastic strands. The second portion 14*b* serves to advance and maintain the stretch on the elastic strand by applying tension to the composite yarn as will be described.

After passing around the motor-driven roller 14 in the first portion 14*a* thereof, the inelastic strands are passed around a fixed-roller body 15 and then again around the portion 14*a* of the roller in a plurality of convolutions to accomplish the desired degree of drafting and tensioning.

At substantially zero tension, the inelastic strands 13 are passed through a humidifying or wetting assembly 16 to the pneumatic-joining assembly 9.

In the pneumatic-joining assembly 9, the elastic yarn is stretched, the inelastic yarn at practically zero tension, having been wetted, is subjected to matting or interlacing around the elastic yarn to achieve the coalescence previously described.

The composite yarn which results, shown at 19 and designated by alternating light and dark portions is wound in at least one and preferably a plurality of turns around the second portion 14*b* of the roller 14 and then delivered to the take-up assembly 7 to be wound on the spool 8, passing through if desired, other transmission and feed elements including the tensioning and drafting elements 17 and 18 shown only diagrammatically.

Figure 5:
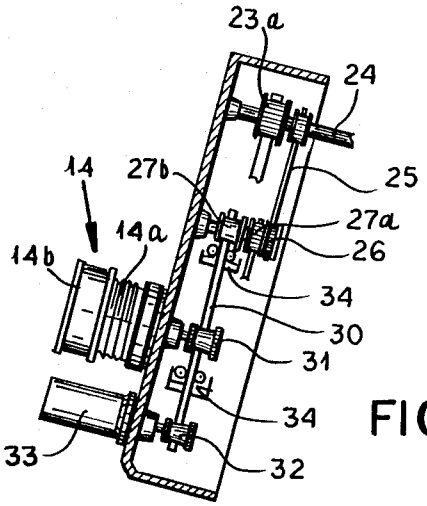
FIG. 5 is a cross-sectional view taken generally along the line V—V of FIG. 4.

As best seen from FIGS. 3 and 5, the portion 14*a* of the roller has a plurality of grooves each of which receives one turn or convolution of the inelastic strand.

Corresponding grooves are provided on the fixed roller 15 which is made from ceramic material to achieve, with low wear, a high degree of friction against the inelastic strand. The grooves on the rollers 14 and 15 are intended to prevent lateral displacement of the strands which might cause overlapping of the turns and contribute to a blockage of the strands and could create difficulties in the merger of the inelastic strands with the elastic strand 11.

The lateral spreading of the fibers of the inelastic strand can be maximized if this strand is subjected during feeding, not only to wetting as has been described, but also to a stretching or drafting with the tension on the strand being progressively reduced as the strands wind around the rollers 14 and 15 until the tension reaches a minimum value at the point that these strands enter the pneumatic-joining assembly 9.

When a texturized inelastic strand is used and has been subjected to stretching (elongation) followed by release of tension, it develops a relaxed or spread construction which proves to be optimal for coalescence with the elastic strand under the action of the pneumatic jet.

The humidifying or moisturizing assembly comprises a roller floating in a vessel containing water or another wetting liquid. As the strand passes over this roller, its spread fibers are covered with a layer of water which contributes a significant mass to these fibers and increases their areas so that the effect of the pneumatic jet on the fibers is significantly greater than that which can be achieved with dry fibers.

By comparison with the action using dry fibers, it is possible to obtain a major improvement in efficiency and hence an increase in productivity and a reduced specific consumption of compressed air.

Because the composite yarn 19 is passed in at least one and preferably a plurality of turns around the roller portion 14*b*, the elastic strand is brought to a satisfactory level of stretch or tension in the pneumatic-joining assembly.

The cylindrical surface of the portion 14*b* of roller 14 is smooth and free from grooves, because after coalescence of the strands, it is no longer required to maintain the fibers of the inorganic strand in a spread condition and a lateral slippage of the composite yarn does not have any significant disadvantageous effect.

Before being wound on the spool 8, the composite yarn can be subjected via a roller 20 to an oil treatment, to a paraffin treatment or the like and when such treatments are not required, can be directly conveyed to the spool 8.

Figure 6:
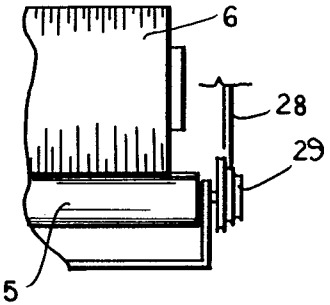
FIG. 6 is a cross section taken along the line VI—VI of FIG. 4.
Figure 4:
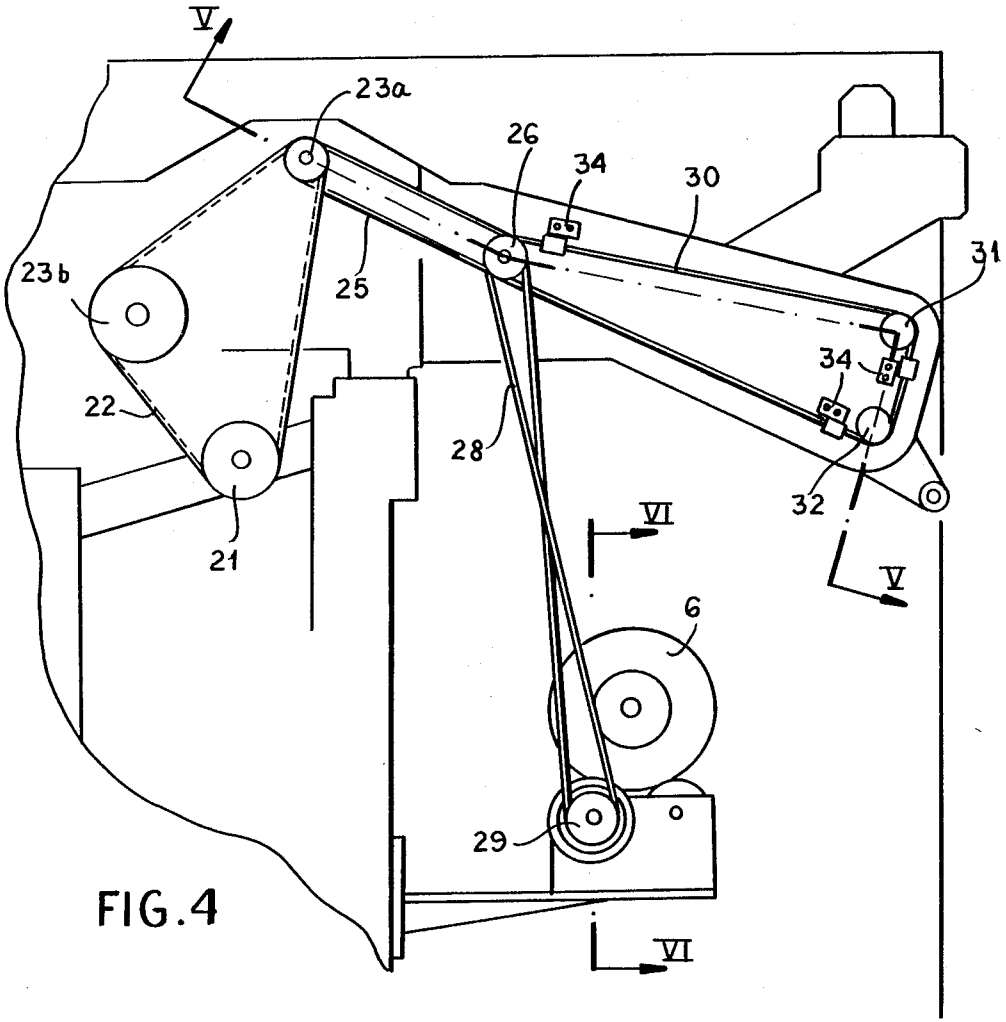
FIG. 4 is an elevational view, also in highly schematic form illustrating a drive system for the machine.

As can be seen from FIGS. 4–6, the machine is driven by a drive pulley 21 connected to an electric motor, not shown, which drives via a belt 22 the pulleys 23*a* and 23*b* of the take-up assembly and any cams which are used to ensure effective distribution of the composite yarn on the take-up spool. The construction of the take-up assembly can be of a known type and thus need not be described in detail.

A pulley 24 is coupled to the shaft of the pulley 23*a* and drives via a belt 25 a pulley 26 which rotates the pulleys 27*a* and 27*b* which are coaxial and rotatably entrained by the pulley 26.

A belt 28 passes over the pulley 27*a* and engages a pulley 29 having a plurality of grooves at respective diameter steps. The pulley 29 is connected to one or both of the rollers 25 for support and rotation of the bobbin 26 carrying the elastic strand.

The pulley 27*b* is coupled by a belt 30 to the driven pulleys 31 and 32 driving the roller 14 and an auxiliary roller 33.

The pulleys 27*b*, 31 and 32 are conical pulleys and the position of the belt 30 on these pulleys is determined for each of them by the respective belt position control assembly 34 capable of shifting the belt position axially along the respective conical pulley. Because of these position shifts by the assemblies 34, the transmission ratios between the driven pulleys and the drive pulley 26 can be established to optimize the speeds of the respective pulleys and provide the ideal feeding speeds for the respective strands. This allows for complete adjustment of the machine to the various dimensions of the inorganic strands to be joined, giving tension values which are better adjusted for feeding of the strands to the pneumatic-joining assembly 9.

The stepped diameter grooves of pulley 29 permit selection of the rotational speed of the rollers 5 and the bobbin 6 to vary the degree of tension and/or elongation in the elastic strand 11.

The auxiliary roller 33 allows an independent feed of a third type of strand or yarn, for instance a natural fiber such as cotton which requires its own autonomous tension and can be coalesced with the composite yarn after it has been formed in the pneumatic-joining assembly 9.

When a composite yarn is to be formed from two or more inelastic yarns coalesced with each other and the elastic yarn, the inelastic yarns can be fed parallel to one another along the same path or lodged independently in separate grooves in the roller portion 14*a* and fed separately by the rollers 14 and 33, the latter being smooth or provided with grooves as may be required, especially in the case where there are different tension requirements for the respective strands. Of course, several assemblies 10 can be provided for respective grooves of inelastic strands, driven separately at controllable speeds and delivering the respective inelastic strands to a common pneumatic-joining assembly.

The pulley has different diameters for the portions 14*a* and 14*b* for feeding the inelastic yarn and receiving the composite yarn, respectively, the relative diameters being selected by the different speeds desired for the inelastic strands and the composite yarn.

For a correct operation of the machine, in order to obtain optimal coalescence between the inelastic yarn and elastic yarn, a tension is provided in the inelastic strand, before it reaches the feeding roller and established by the friction of the reel or spool from which it is drawn off and, if necessary, by a braking element for the strands. In a non-limitative example, for some yarns the tension can be between 2 and 15 grams.

At the entry to the pneumatic-joining assembly 9, the tension of the inelastic yarn is zero. This tension decreasing progressively in the successive windings, a minimum of two and preferably more convolutions being provided between the roller 14 and the fixed body 15.

The composite yarn is withdrawn from the pneumatic assembly 9 with a tension sufficient to compensate for any braking effect resulting from pneumatic action on the yarns or strands on the pneumatic assembly.

It is for this reason that the diameter of the portion 14*b* of the roller 14 is greater than the diameter of the portion 14*a* of that roller by 10 to 30% of the latter. Of course, a number of rollers 14 with various ratios of diameters and diverse combinations of them can be available to be selectively mounted depending on the characteristics of the yarns being handled.

The tension applied to the elastic strand prior to and within the joining assembly is conveniently such as will produce an elongation of 100 to 500% of the elastic yarn.

Elongations of even more, up to say 1000% can be used as requirements dictate, the transition being selected in part by varying the step of the pulley 29 which is used.

The yarn is wound on the spool 8 with a tension of a few gram generated with the aid of a brake 18 so as to obtain the desired degree of compactness of the yarn on the spool. Of course, with selection of other strands or yarns, other tensions for elongation values can be used and it is possible to select these values differently for different composite yarns.

Recapitulating, an enlarged schematic view of the configuration of one elastic yarn 11 joined with two inelastic yarns 13, forming a composite yarn 19 is shown in FIG. 7 and 8, respectively, depicting two discontinuous inelastic yarns and two continous texturized inelastic yarns, showing the arrangement of the yarns before and after being subjected to the action of the pneumatic joining assembly 9.

Figure 9:
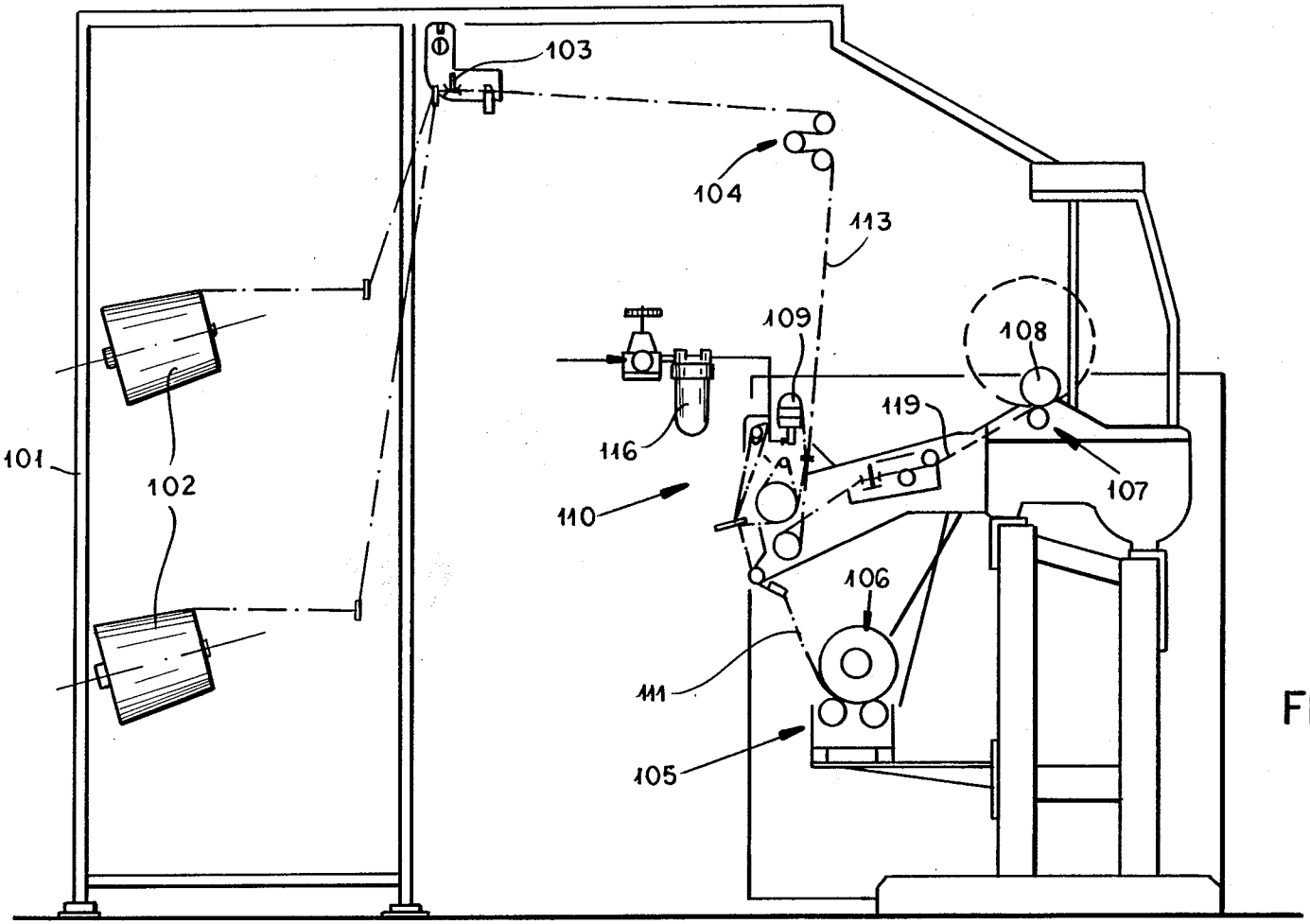
FIG. 9 is a diagrammatic elevation of the machine according to the invention, in a different embodiment.

As shown in FIG. 9, the machine according to the invention has a support frame 101 for the spools of the rigid yarn 102, whose yarn is fed via a yarn sensor and a tensioning device 103 with caps or washers and an adjustable tensioning device 104, for instance of the spool type as shown, capable to impart to the yarn the stress value required for the optimal joining of the yarns, to a joining assembly comprising a unit 105 for feeding the elastic yarn from a bobbin 106 to the take-up unit 107 for winding the composite yarn on a spool 108. A pneumatic joining assembly 109 is provided along the path and a unit 110 for the prearrangement or feed of the inelastic yarn, capable to put it in the optimal condition for joining with the elastic yarn, is also provided.

Figure 10:
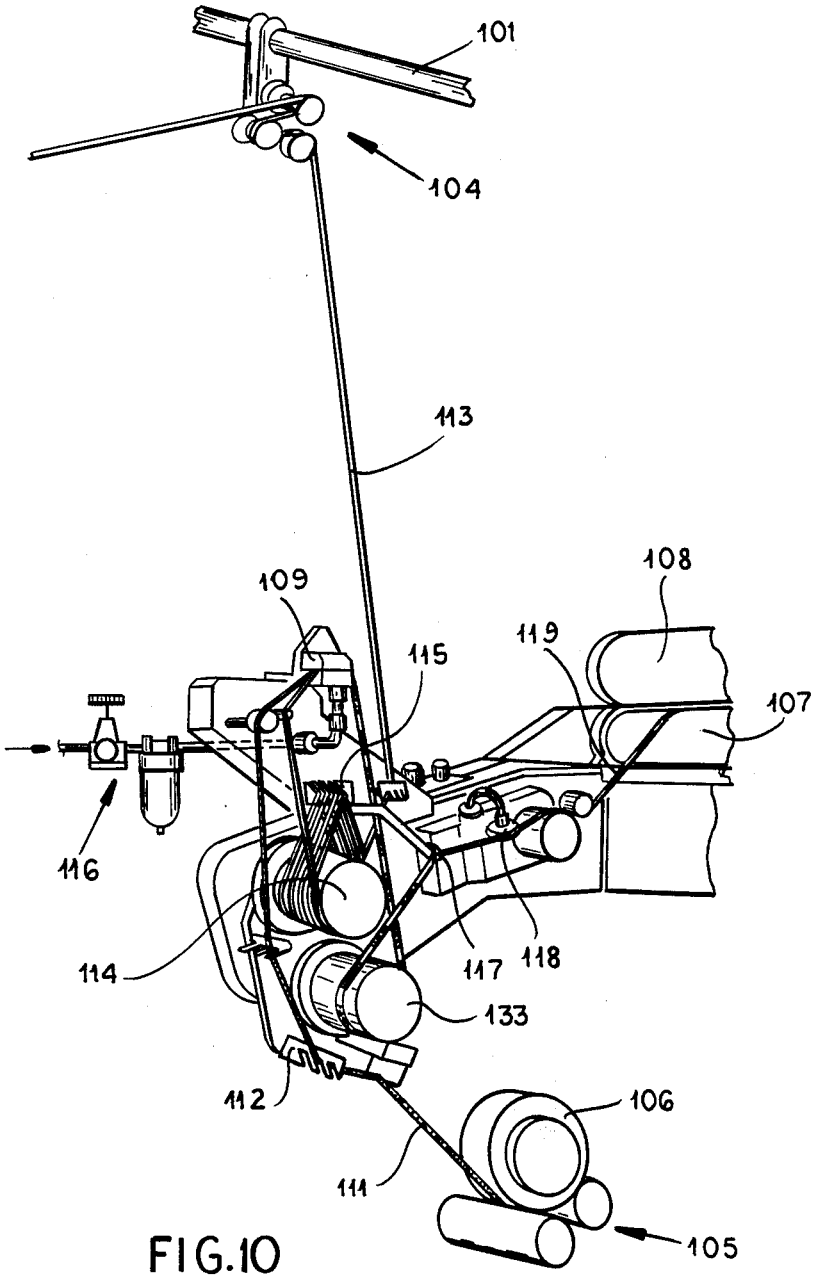
FIG. 10 is an enlarged perspective view of the yarn-prearrangement unit (presetting) of the embodiment shown in FIG. 9, in the case where one inelastic yarn is joined with one elastic yarn.

As shown in greater detail in FIG. 10, the elastic yarn 111, in heavy lines in the FIGURES, coming from the bobbin 106, is guided over a yarn guide with combs 112 and over subsequent transmission means capable of defining its travel path towards the pneumatic joining element 109. A inelastic yarn 113 shown in light lines coming form the spool 102, is tensioned by the tensioning devices 103 and 104 and from there passes over a guide with grooves 115 again back to the roller 114, for a few more convolutions until required degree of relaxation of the tension imparted by the tensioning devices 103 and 104 is reached. Subsequently the inelastic yarn 113 reaches the pneumatic joining element 109.

In order to provide the humidity value desirable for the yarn, instead of the use of a humidifier 16, as described previously, the pneumatic joining element 109 is supplied with humidified compressed air, by introducing the necessary water into the pneumatic flow via a humidifier unit 116. In this way, the action of the pneumatic jet on the fibers of the inelastic yarn is increased due to the presence of minute drops of water whose mass acts deflectingly upon the fibers when the air comes in contact therewith, in an even more energetic manner.

For a correct functioning of the machine, in order to obtain an optimal joining between the inelastic and the elastic yarns, a tensioning of the inelastic yarn before the feeding roller, ranging between 10% and 75% of the breaking load is provided. A convenient tension degree for the most widely used fibers, such as polyamides and polyesters can range between 0.1 and 3 grams/denier, preferably between 0.5 and 2.8 grams/denier.

The tension of the inelastic yarn upon entering the pneumatic joining unit is close to zero, the tension previously imparted by the tensioning devices 103 and 104 being totally recovered after a few passes around the roller 114 and the guide 115.

In this embodiment, the use of the grooved guide 115 insures the proper guiding of the yarn 113. The roller 114 can be of the smooth type without the grooves preventing the slippage of the yarn. In the pneumatic joining element, as already described, the desired joining occurs as a result of the interlacing of the filaments of the inelastic yarn around the elastic yarn. The composite yarn 119 thus formed, represented in alternatingly light and heavy lines in FIG. 10, is then wound in one or several convolutions on a roller 133, rotating at a peripheral velocity lower by 5 to 50% than that of the roller 114, and from there via optional subsequent transmission and tensioning means 117, 118 to the take-up unit 107 which collects it on the spool 108.

Taken as an example, a texturized polyamide yarn of the inelastic type of a count of 15/F7 denier is joined with an elastomeric yarn of 20 deniers with a tension of the polyamide yarn upstream from the roller 114 of 12 grams and a tension when entering the pneumatic joining element of 0.1 grams; prior to entering the pneumatic joining element, the elastomeric yarn is subjected to stretching (drawing) at a ratio of 1/3.2. An extraction tension of 6 grams is used at the exit of the composite yarn from the pneumatic joining unit.

The peripheral velocity of the roller 133 is so established as to reduce the tension of the composite yarn to approx. 2 grams for the take-up on the spool.

The value of the residual tension of the inelastic yarn fed, to the pneumatic joining unit is the minimal value which insures a feeding of the same yarn without looping and the like and is maintained at the lowest possible level.

The actuation of the roller 114 and 133 can be done as previously described with conical pulleys, or, in cases where it is required to have a higher degree of constancy of the yarn traction than can be obtained with such means, fixed-diameter pulleys or sprockets can be used in combination with toothed belts. The pulleys can then be replaced by others for variations in the transmission ratio, if required.

This makes it possible to insure the maximum possible degree of constant rotational speed of the rollers and their constant relationship, when this is of particular importance for the correctly performed joining operation.

The function of the roller 133 can be deduced from that of the roller 33 previously described, when it is not used for feeding another yarn.

Figure 11:
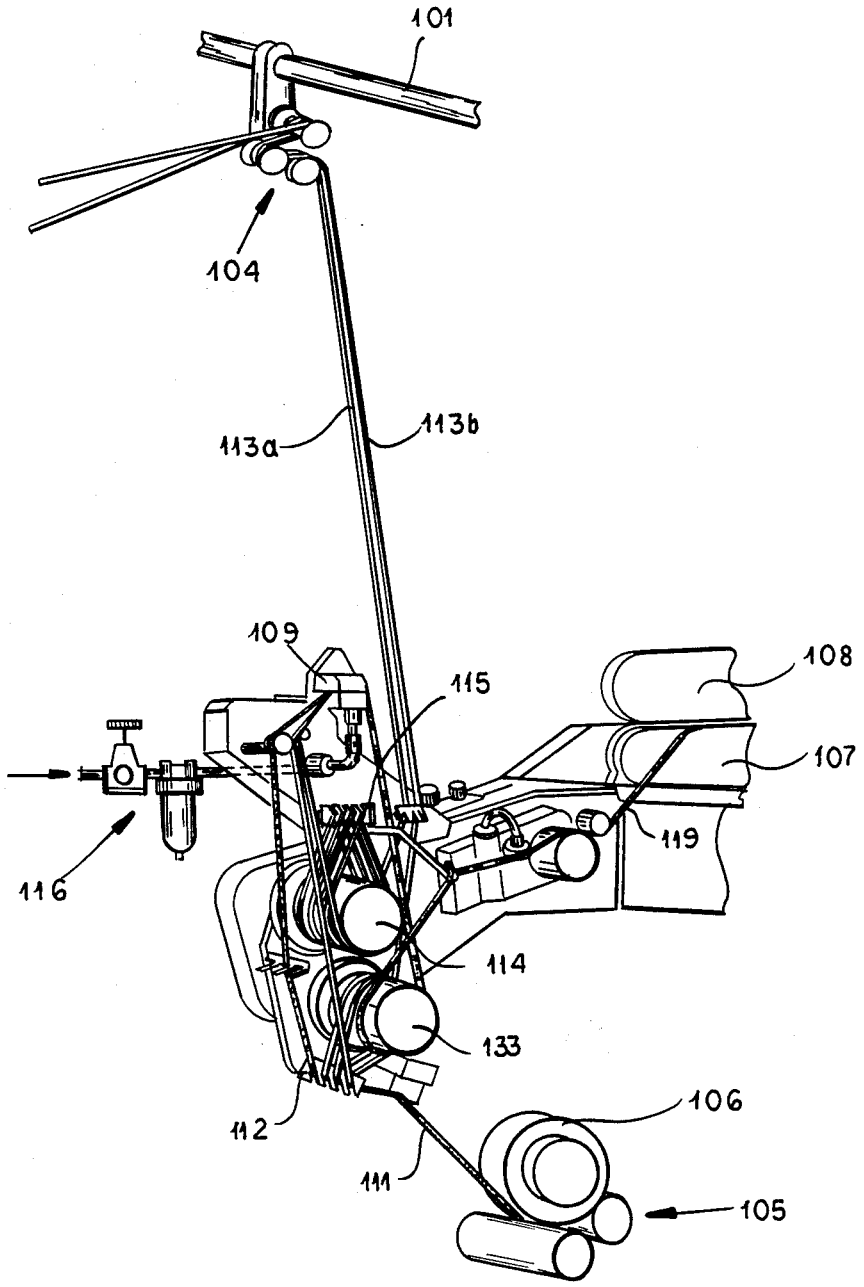
FIG. 11 is a view similar to FIG. 10 of an embodiment in which two inelastic yarns are joined with one elastic yarn.

When it is required to produce a composite yarn from two or more inelastic yarns joined to the elastic yarn, they can be fed parallel to one another along the same path, or wound independently in separate areas of the roller 114 shown in FIG. 11, alternatively, two inelastic yarns 113*a*, 113*b* are fed separately via the rollers 114 and 133 and wound on the fixed guides 115 and 112 respectively. In this case, the rollers 114 and 133 have diameters and rotational speeds selected on the basis of the optimal feeding values required for the yarn used.

After the joining, the composite yarn 119 can again be wound on the roller 133, in order to be fed in this way to the spool 108, if the rotational speed of such spool is accordingly adjusted. Otherwise, a second independent motor-driven roller can be provided for the extraction of the composite yarn from the pneumatic joining unit 109, leaving the rollers 114 and 133 the sole function of feeding the inelastic yarns 113*a* and 113*b*.

For instance, in order to join a polyamide yarn with a count of 70/F34 deniers to a cotton yarn with a count of 2/24NE (BRITISH SYSTEM) a tension of 18 grams is used on the first one and a tension of 15 g on the second one, and for the respective winding one the rollers 114 and 133 capable to carry them to the pneumatic joining unit, for the polyamide yarn a tension of 0.1 g and for the cotton yarn a tension of 3 g is used. The roller 133 has such a peripheral speed (velocity) as to reduce the tension of the composite yarn from 65 g at the exit from the pneumatic joining unit to 25 g when it is taken up on the spool. The elastomeric yarn in this example would have a count of 140 deniers and will be stretched at a rate of 1/3.8.

Figure 12:
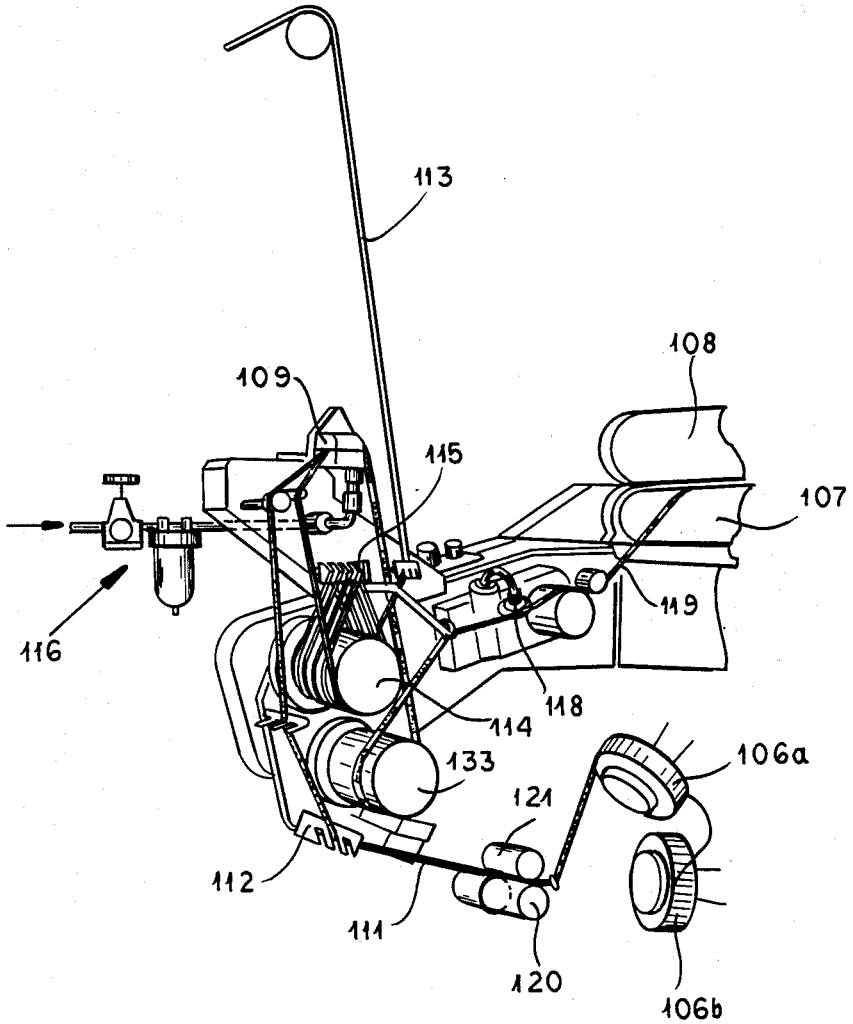
FIG. 12 is a perspective view of the apparatus according to the invention for the connection with a texturizing machine having a unit for the continuous feeding of the elastic yarn.

According to another embodiment of the invention as shown in FIG. 12, the machine according to the invention can be connected downstream of a texturizing machine TM so that, in order to achieve the highest degree of spreading of the filaments of the inelastic yarn 113, it uses the extraction tension of the same yarn from the texturizing machine TM, which already puts the yarn in the desired condition for such spreading.

However, in order to make such a connection, the continuity of the elastic yarn has to be guaranteed, so that it does not become necessary to shut off the entire texturizing machine in order to replace an emptied elastic yarn bobbin. For this purpose the feeding of the elastic yarn is provided through axial deployment from a firmly held bobbin 106*a*, consisting of motor-driven roller 120, on which the elastic yarn winds with one or more turns, in order to achieve the friction necessary for the traction, with the aid of counter-roller 121.

In this way it is possible to connect the final extremity of the yarn of the bobbin 106*a* in use to the initial extremity of a second bobbin 106*b* awaiting use, so that one can proceed without interruption to the deployment of the second bobbin when the first bobbin 106*a* is finished, with the possibility of bringing in a new bobbin connected to the terminal extremity of the bobbin 106*b*, while this is in use, replacing the already used bobbin in waiting.

Figure 13:
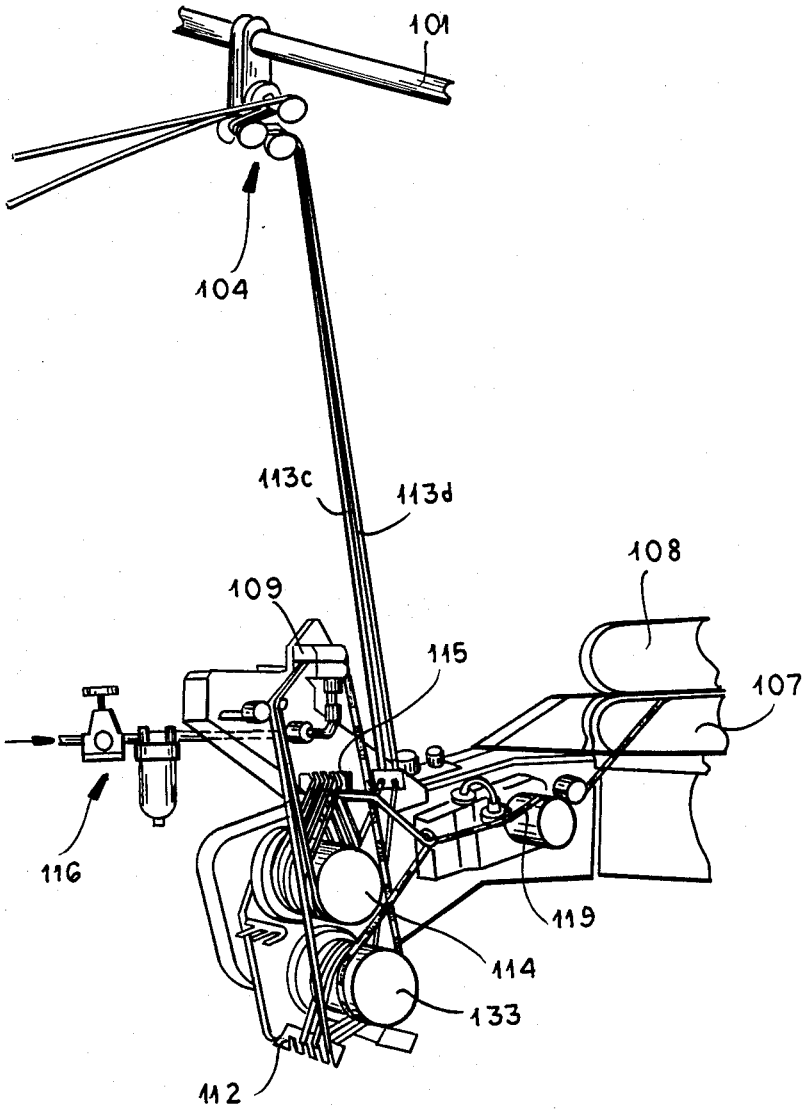
FIG. 13 is another perspective view of the yarn-feed unit according to the embodiment of FIG. 9, in the case of two inelastic yarns being joined.

The machine according to the invention can also be used for joining several yarns of the inelastic type (synthetic or natural, textured or non-textured) to each other, with various characteristics according to needs, such as, for instance, shown in FIG. 13, joining a yarn 113*c* of natural fiber such as cotton, wool, silk or the like with a yarn 113*d* consisting of synthetic fibers, such as polyamide, polyethylene, polypropylene, and the like, winding these yarn respectively on the rollers 114 and 133 and the guides 115 and 112, after having imparted to them an additional tension value with the aid of the tensioning group 104. The so-prearranged yarns can be sent to the pneumatic joining unit 109, whereby a composite yarn is produced which can be fed with one or several convolutions on the roller 133, in order to insure the proper traction value to the winding group 107.

As an example, in order to join a wool yarn 113*c* of 29000 NM (metric system) with a polyamide yarn 113*d* of 30/F6 deniers, a tension of 9 g is imparted to the wool yarn via the tensioning group 104, upstream of the roller 114, while to the yarn of polyamide 113*d*, the tensioning unit 104 imparts a tension of 14 g upstream of the roller 133; these tensions are then reduced to a value of 0.5 to 4 g during the feeding to the pneumatic joining unit 109.

I claim:

1. An apparatus for coalescing a plurality of strands into a composite yarn, comprising:

a pneumatic-joining assembly adapted to receive a plurality of strands and provided with at least one pneumatic jet adapted to cause matting of said strands and the coalescence thereof into a composite yarn;

means for feeding at least one substantially inelastic strand of continuous texturized synthetic fiber or discontinuous natural or synthetic fiber to said pneumatic-joining assembly and alternately stretching and relaxing said inelastic strand;

means for feeding an elastic strand composed of an elastomeric material in a stretched state to said pneumatic-joining assembly whereby the stretched elastic strand is contacted with the inelastic strand which has been alternately stretched and relaxed;

means interposed between said means for feeding said inelastic strand and said assembly for conditioning said inelastic strand for facilitating its coalescence with said elastic strand and including:

means for controlling tension of said inelastic strand, and means for humidifying said inelastic strand; and means for relaxing tension on said composite yarn and winding the composite yarn on a spool.

2. An apparatus for coalescing a plurality of strands into a composite yarn, comprising:

a pneumatic-joining assembly adapted to receive a plurality of strands and provided with at least one pneumatic jet adapted to cause matting of said strands and the coalescence thereof into a composite yarn;

means for feeding at least one substantially inelastic strand of continuous texturized synthetic fiber or discontinuous natural or synthetic fiber to said pneumatic-joining assembly;

means for feeding an elastic strand composed of an elastomeric material to said pneumatic-joining assembly; and means interposed between said means for feeding said inelastic strand and said assembly for conditioning said inelastic strand for facilitating its coalescence with said elastic strand and including:

means for controlling tension of said inelastic strand, and means for humidifying said inelastic strand, said pneumatic-joining assembly, said means for feeding said elastic strand and said means for conditioning said inelastic strand forming a joining unit with a common drive.

3. The apparatus defined in claim 2 wherein said joining unit comprises a frame, said means for feeding said elastic strand including a pair of rollers rotatable by said drive for supporting and rotating a bobbin of said elastic yarn, said means for conditioning said inelastic yarn including a roller rotatable by said drive and a fixed body over which said inelastic yarn pass in at least one turn, said apparatus further comprising a roller receiving and engaging the composite yarn and rotatable by said drive, and means for winding the composite yarn onto a spool driven by said drive.

4. The apparatus defined in claim 3 wherein the roller engaging said composite yarn and the roller of said conditioning means are coaxial and rigid with one another and have different diameters determining draft to be applied to said inelastic yarn and to said composite yarn.

5. The apparatus defined in claim 4 wherein the roller and said body of said conditioning means are provided with grooves capable of engaging said inelastic yarn and preventing slippage of said inelastic yarn axially thereon.

6. The apparatus defined in claim 4 wherein said drive is so connected to said roller of said conditioning means and said inelastic strand passes between said roller and said body of said conditioning means in a plurality of convolutions such that tension initially applied to said inelastic yarn is reduced substantially to zero before said inelastic yarn enters said pneumatic-joining assembly.

7. The apparatus defined in claim 4 wherein the roller engaging said composite yarn has a diameter and is so coupled to said drive that the tension is developed in said elastic yarn which is capable of compensating for drag applied to said elastic yarn in said pneumatic joining assembly.

8. The apparatus defined in claim 7 wherein said drive and said roller engage said composite yarn and are provided with means operating said drive and said roller so that said composite yarn is elongated between 100% and 1000%.

9. The apparatus defined in claim 4 wherein said body is composed of a ceramic material.

10. The apparatus defined in claim 4 wherein said drive includes a plurality of conical pulleys connected to respective ones of said rollers, a belt passing over said conical pulleys, and means for axially shifting the position of said belt along each of said conical pulleys to adjust the transmission ratio of said drive.

11. The apparatus defined in claim 4 further comprising another roller having an independently controllable speed for independently supplying an inelastic yarn to said composite yarn.

12. A method of making a composite yarn, comprising the steps of:

(a) feeding an elastic strand composed of an elastomeric material through a pneumatic-joining assembly while stretching said elastic strand so that said elastic strand is under tension in said pneumatic-joining assembly;

(b) simultaneously feeding at least one substantially inelastic strand of continuous texturized synthetic fiber or discontinuous natural or synthetic fiber to said pneumatic-joining assembly in contact with said elastic strand and alternately stretching and relaxing said inelastic strand before said inelastic strand is contacted with said inelastic strand;

(c) directing at least one pneumatic jet against said inelastic strand in said pneumatic-joining assembly to cause said inelastic strand to mat to and coalesce with said elastic strand, thereby forming a composite yarn;

(d) relaxing the tension on said elastic strand and winding up the composite yarn on a spool; and (e) wetting said inelastic strand before it is fed to said pneumatic-joining assembly to increase the susceptibility of the inelastic strand to deflection by said pneumatic jet.

13. The apparatus defined in claim 1 wherein the pneumatic-joining assembly comprises a frame supporting a feeding unit for an elastic-yarn bobbin, at least one motor-driven roller for the feeding of inelastic yarn and a fixed guide with grooves for braking of the inelastic yarn, another roller on which the composite yarn winds in at least one turn, a pneumatic joining element, and means for winding the composite yarn on the composite yarn spool.

14. The apparatus defined in claim 13 wherein the roller feeding the inelastic yarns located upstream of the pneumatic joining element, and has smooth surfaces, a fixed guide with grooves being provided capable of receiving the turns of the rigid yarn and to hold them in position, preventing the slippage of the inelastic yarn in a transversal direction, prior to the joining with the elastic yarn.

15. The apparatus defined in claim 13 wherein the roller feeding the inelastic yarn and the other roller are independent from one another and driven to rotate at different speeds.

16. The apparatus defined in claim 13 wherein the fixed guide with grooves is made of a ceramic material capable of applying friction to a yarn surface.

17. The apparatus defined in claim 16 wherein the roller feeding the inelastic yarn and the other roller of the composite yarn are driven by a motor via at least one replaceable fixed pulley.

18. The apparatus defined in claim 13 wherein a further feeding roller for the inelastic yarn is provided, said further feeding roller being equipped with a respective fixed guide with grooves, capable of feeding independently one or more further inelastic yarns with various fibers.

19. The apparatus defined in claim 18 wherein the further feeding roller includes the other roller.

20. The apparatus defined in claim 18 wherein there are as many independent feeding rollers with respective fixed guides as there are inelastic yarns forming the composite yarn.

21. The apparatus defined in claim 18 wherein said other roller is rotationally driven with a peripheral speed lower by 5% to 50% in comparison with the peripheral speed of the roller beeding the inelastic yarn.

22. The apparatus defined in claim 1 wherein the means for controlling tension of the inelastic strand consists of at least one tensioning unit acting upon said inelastic strand and comprises a drafting and feeding roller for the inelastic strand, and a respective fixed guide at which the tension is being relaxed.

23. The apparatus defined in claim 22 wherein said tensioning unit further comprises an adjustable tensioning device with spools of ceramic material between which the yarn follows a "Z"-shaped path.

24. The apparatus defined in claim 22 wherein the inelastic yarn winds around the roller and the fixed guide which has grooves in at least two turns in order to substantially reduce the tension of said yarn.

25. The apparatus defined in claim 1 wherein the means for controlling the tension of the inelastic strand consists of a texturizing machine outputting a rigid yarn directly sent in a tensioned state to the respective drafting and feeding roller and the pneumatic joining element, in the presence of means for the continuous feeding of the elastic yarn by unwinding it from successive bobbins.

* * * * *